US006908346B1

(12) United States Patent
Hyzin

(10) Patent No.: US 6,908,346 B1
(45) Date of Patent: Jun. 21, 2005

(54) QUAD CABLE INTERFACE USING AVAILABLE INSERT

(75) Inventor: Peter Joseph Hyzin, Trabuco Canyon, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/761,722

(22) Filed: Jan. 20, 2004

(51) Int. Cl.[7] ..... H01R 13/10; H01R 33/00
(52) U.S. Cl. ..... 439/682; 439/608
(58) Field of Search ..... 439/682, 607, 439/608, 701, 579–580

(56) References Cited

U.S. PATENT DOCUMENTS

| | | | | |
|---|---|---|---|---|
| 4,834,678 A | * | 5/1989 | Emadi et al. | 439/701 |
| 4,906,199 A | * | 3/1990 | Twomey et al. | 439/95 |
| 5,263,876 A | * | 11/1993 | Johnescu et al. | 439/620 |
| 6,575,761 B1 | * | 6/2003 | Regnier | 439/63 |
| 6,669,502 B1 | * | 12/2003 | Bernhart et al. | 439/460 |
| 6,764,350 B2 | * | 7/2004 | Kosmala | 439/752 |

* cited by examiner

*Primary Examiner*—Hae Moon Hyeon
(74) *Attorney, Agent, or Firm*—Roger C. Turner

(57) ABSTRACT

A connection system is provided for connecting conductors of a quad cable (12) to terminals (14), through the use of a low cost and commonly available insert (30) that has multiple rows and columns of passages (170) that each contains a double-ended pin (34), with the rear ends of the pin contacts engaged with the terminals. A quad terminator (60) has four contacts (82) lying within a terminator main shield (90), the four contacts each terminated to one of the cable conductors, and the four contacts having mating ends (86) projecting forward of the terminator housing. A backshell adaptor (62) is provided which has bores (110) that each receives and retains the main shield of a quad terminator, with the contact mating ends projecting forward beyond a front face (142) of the backshell adaptor. Each of the four contacts of the terminator project into the passages (170) of the insert frame, where the terminator contacts engage the rear ends of four pins in the four passages. The insert may be inserted forwardly into a bay (40) of a shell (42) until shoulders of the insert abut corresponding shoulders in the bay. The backshell adaptor is fastened to the shell to hold the backshell adaptor in place and to hold the insert in place in the bay.

9 Claims, 2 Drawing Sheets

QUAD CABLE INTERFACE USING AVAILABLE INSERT

BACKGROUND OF THE INVENTION

A standard aircraft Ethernet interconnect system (for carrying high rate bits between computer circuits on the aircraft) uses a special quad cable that has four individually insulated conductors and a grounded main shield around the conductors, and has a 100 ohm characteristic impedance. The four cable conductors are terminated to contacts of a Quadrax connector that is inserted into a bore of a specialized metallic insert having several bores and holding specialized contacts that connect the four Quadrax contacts to terminals. A common type of such terminals includes socket contacts that project from a connector that is mounted on a circuit board. The special metallic insert that receives the Quadrax connector is expensive.

A low cost header for connecting other pairs of contacts includes a plastic molded frame having multiple rows and columns of passages and a double-ended pin in each passage. The rear ends of the passages can receive terminals of a mating connector. It would be desirable if the front ends of the insert pins could electrically mate with the contacts of the Quadrax type connector. The much lower cost of the molded plastic insert would greatly reduce the cost of the Ethernet connector system.

SUMMARY OF THE INVENTION

In accordance with one embodiment of the present invention, a connection system is provided for connecting insulated conductors of a quad cable to terminals, using an insert of the type that has a molded plastic insert frame with multiple rows and columns of passages that each holds a double-ended pin. The mating ends of the pins are engaged with the terminals, and the present invention provides means for connecting conductors of the quad cable to rear ends of the pins that lie within the insert frame.

Applicant provides a cable-connected quad terminator with four contacts surrounded by a terminator main shield. Rear ends of the terminator contacts are terminated to the four cable conductors, while mating ends of the terminator contacts project forward of the terminator main shield. Applicant also provides a backshell adaptor having through bores into which the quad terminator can be inserted, the adaptor having retainers that removably retain the quad terminator in a fully installed position wherein mating ends of the contacts and subshields around each contact, project forward of the backshell adaptor. The backshell adaptor has a front face lying facewise adjacent to the rear end of the insert, with the four projecting parts of the terminator contacts and the subshields projecting into four corresponding passages of the insert frame. Each contact projecting part engages a rear end of a pin lying in an insert passage to complete the connection.

The novel features of the invention are set forth with particularity in the appended claims. The invention will be best understood from the following description when read in conjunction with the accompanying drawings.

DESCRIPTION OF THE PREFERRED EMBODIMENT

Figures 1, 2:
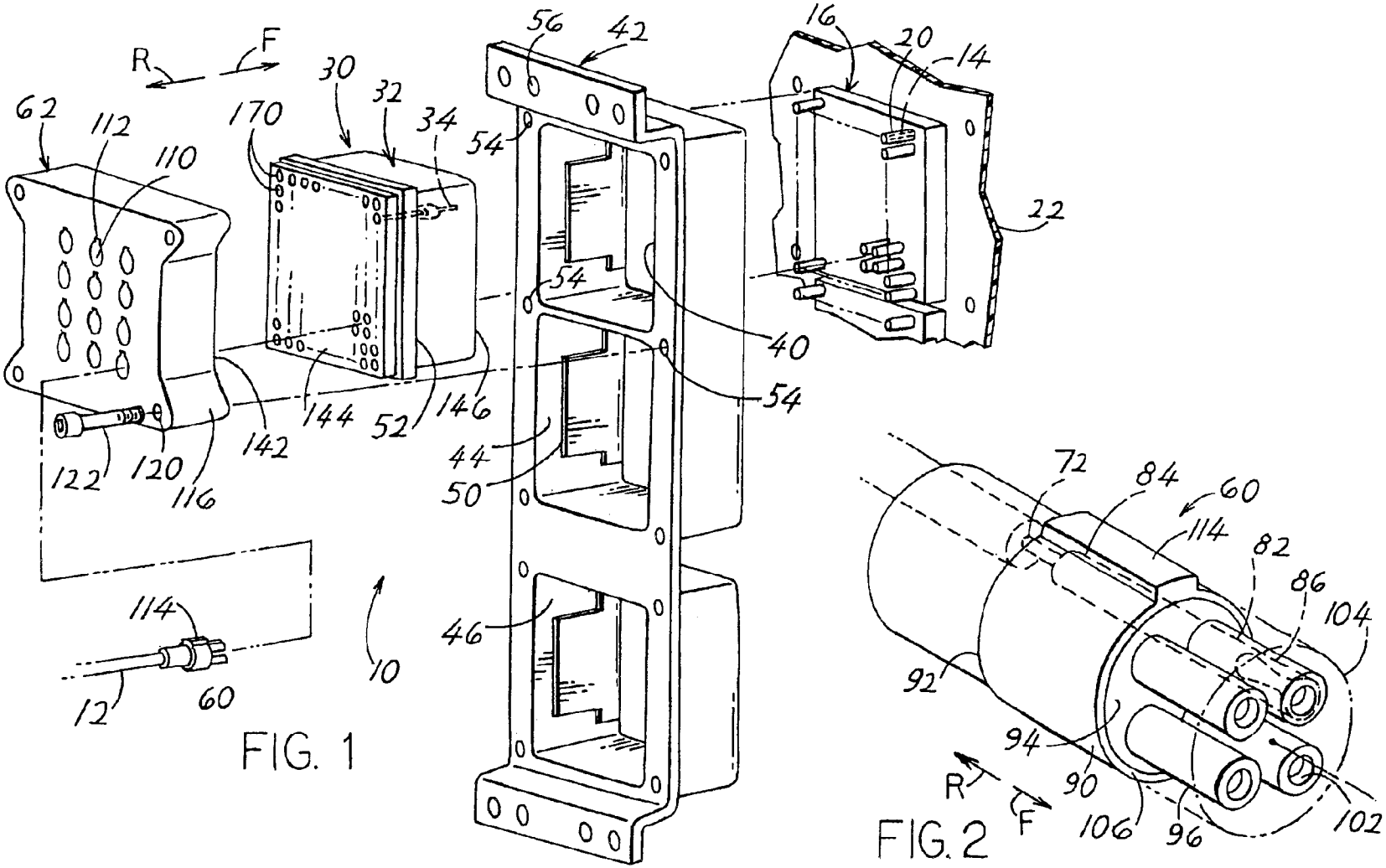
FIG. 1 is an exploded front isometric view of a connection system of the present invention.
FIG. 2 is a rear isometric view of the quad terminator of the system of FIG. 1, and also showing, in phantom lines, the rear shield of a prior art Quadrax connector.

FIG. 1 shows a connection system 10 for connecting conductors of a Star Quad cable 12 to terminals 14 of a connector 16. Each terminal 14 lies within a miniature stainless steel subshield 20. Such connectors 16 are commonly used in Ethernet connection systems on aircraft, to carry high speed data signals between computer circuits. Previously, a special metallic insert was used with a special Quadrax connector that was terminated to conductors of the cable 12, to connect to the another Quadrax connector in a special metallic insert. Such special metallic inserts were expensive.

It has occurred to applicant that a Standard insert 30 of a type that includes a molded plastic frame 32 and multiple double-ended insert contacts, or pin contacts, or pins 34 might be used instead to make connections between the cable conductors and the terminals 14. The standard insert 30 is widely available at low cost and is commonly used as a header to connect pairs of socket contacts. In many uses, the standard insert 30 is mounted in a bay 40 of a mounting shell 42. The particular shell 42 is of a type that has three bays 40, 44, 46, with a rearwardly R facing shoulder 50 in each bay that engages a forwardly-facing shoulder 52 molded into the insert frame 32. The shell also has threaded holes 54 around each bay for mechanical connection to devices, and has flanges with unthreaded holes 56 for mounting the shell on other equipment.

Figure 4:
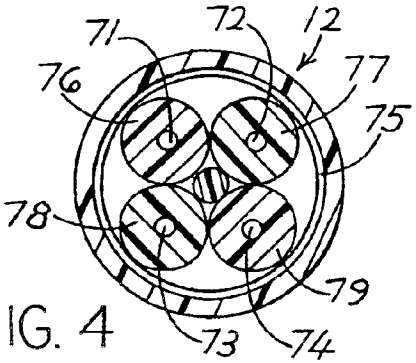
FIG. 4 is a sectional view of the quad cable of FIG. 3.

In accordance with the present invention, applicant provides a quad terminator 60 which is terminated to the four conductors of the quad cable 12, and applicant also provides a backshell adaptor 62 that enables the four contacts of the quad terminator 60 to electrically connect to four pins 34 of the standard insert 30. FIG. 4 shows that the quad cable 12 includes four conductors 71–74, four insulators 76–79, each insulator surrounding a conductor such as 71 along the length of the conductor (except where it is bared to make a connection). The quad cable also has a grounded cable shield 75. FIG. 2 shows that the quad terminator device, or quad terminator 60 has four contacts 82 that each has a rear end 84 that is terminated to a cable conductor such as 72 of the cable and that has a front end 86. The terminator has a terminator shell or main shield 90 with a step at 92, that encloses parts of the cable conductors such as 72 at rear ends 84 of the contacts. The quad terminator also has four subshields 96 that each surrounds only one of the contacts 82. The subshields each have mating ends with tapered entrances 102 that can receive a pin end. The subshields 96 are preferably formed of stainless steel, and are separated from each other and from the main shield 90 by the insulation 94. It is noted that applicant's quad terminator 60 is largely similar to prior Quadrax connectors, except that the present quad terminator 60 is devoid of a main shield front end indicated at 104 that previously surrounded the mating ends of the contacts 82 and the mating ends of the subshields 96 that surround the contacts. Applicant's contact mating ends and subshields project forward of a front end 106 of the main shield 90 and of the insulator.

The backshell adaptor 62 shown in FIG. 1 has a plurality of bores 110 that are each constructed to receive and retain a quad terminator 60 of the construction shown in FIG. 2. It is noted that each bore 110 has a polarizing groove 112 that corresponds to a polarizing projection 114 in each quad terminator to fix the orientation of the terminator. The backshell adaptor has sideward projections 116 with fastener-receiving holes 120 that each receives a fastener 122 with a threaded end that can thread into a corresponding one of the hole 54 in the shell 42.

Figure 3:
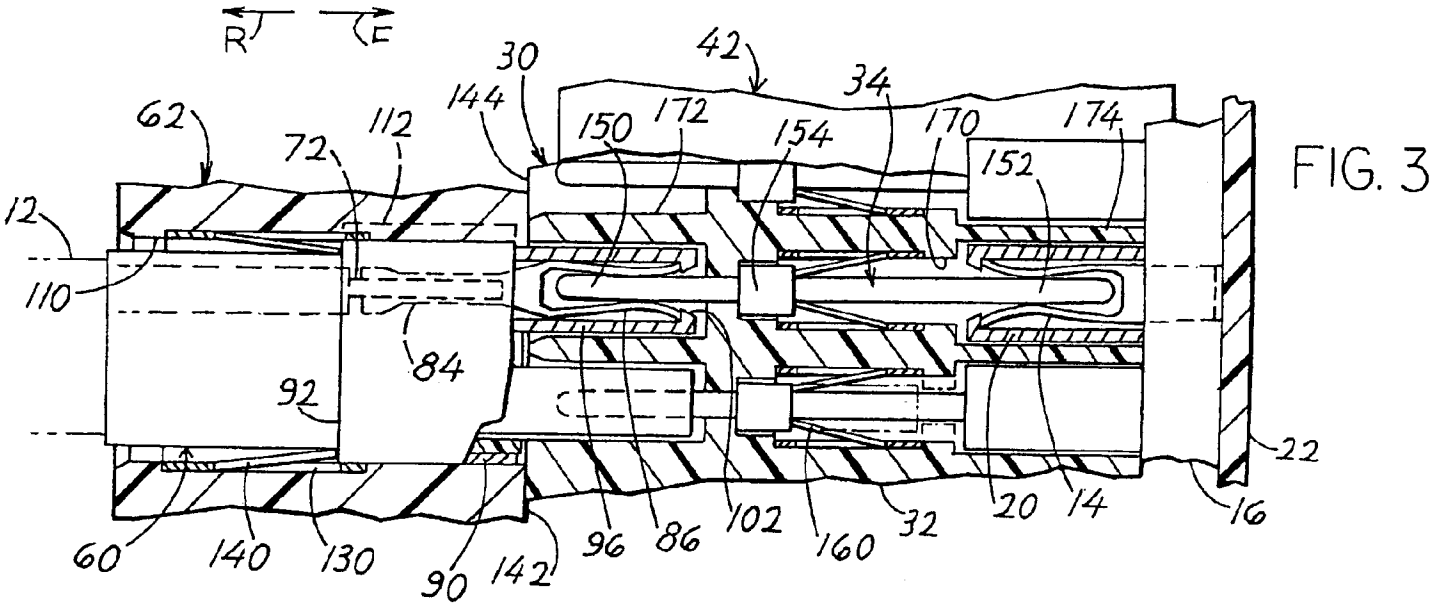
FIG. 3 is a partial sectional view of the system of FIG. 1, with all parts fully connected.

FIG. 3 illustrates the manner in which the insert is used to connect the terminals 14 of the connector 16, to the conductors such as 72 of the quad cable 12. The backshell adaptor 62 has a retainer 130, the particular retainer shown including the common clip type with resilient tines 140 that abut the rearwardly-facing shoulder 92 on the terminator main shell 90. When the quad terminator 60 is fully installed in the backshell adaptor 62, the mating ends 86 of the terminator contacts project forward of a front face 142 of the backshell adaptor, as do the subshields 96. When the backshell adaptor is mounted on the mounting shell 42, the front face 142 of the backshell adaptor lies substantially facewise against a rear face 144 of the insert 30. By "substantially" applicant means that there is no more than a small gap between the faces 142, 144, which must be small enough to assure that the contact front mating ends 86 can fully engage the rear ends 150 of the pins 34 of the insert 30. Each pin 34 has rear and front ends 150, 152 and has a middle 154 that is captured in the insert frame 32. Applicant shows clips with tines 160 that releasably retain the pin middles portions. However, it is also possible to overmold the insert frame 32 around the pin middle portions to lock the pins in the frames.

As shown in FIG. 1, the insert frame 32 has multiple through passages 170 that each extends between the rear and front faces or ends 144, 146 of the insert frame. The standard insert 30 has one hundred-fifty passages arranged in ten horizontal rows and fifteen vertical columns, each passage normally holding a pin 34. The passages of each row are spaced at a pitch of 0.1 inch. As shown in FIG. 3, each terminator contact front end 86 and the subshield 96 that surrounds it, are each forwardly insertable into a rear end 172 of an insert passage 170. The passage front end 174 similarly receives a terminal 14 and a surrounding terminal subshield 20.

The backshell adaptor 62 of FIG. 1 has twelve bores 110 arranged in four horizontally-extending rows and three vertically-extending columns. Additional backshell adaptors can be used in connection with another insert lying in bay 46, and a double-length backshell adaptor can be used to hold two inserts in the two bays 40, 44.

Figure 6:
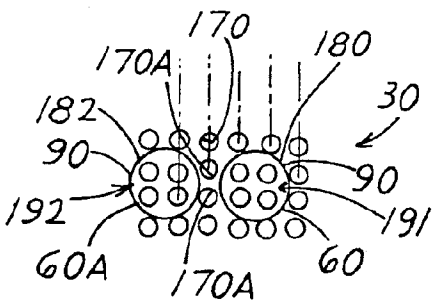
FIG. 6 is a rear elevation view of a portion of the insert of FIG. 1, and also including circles indicating the outlines of the terminator main shields of the quad connector of FIG. 1.
Figure 5:
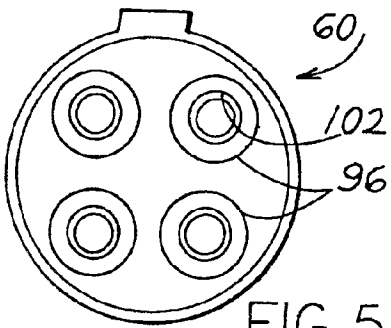
FIG. 5 is a rear elevation view of the quad terminator of FIG. 2.

FIG. 6 shows the outlines at 180, 182 of the main shields 90 of two quad connectors, or terminators 60, 60A whose contacts and the corresponding subshields have been inserted into passages 170 of the insert 30. The contacts and subshields of the first terminator 60 enter four passages of a first group 191 of four passages. The second terminator 60A, has contact rear ends that enter passages of a second group 192 of four passages. The two groups 191, 192 of four passages each, must be separated sufficiently to at least account for the thickness of the walls between bores of the backshell adaptor. As a result, at least two passages 170A lie between the two groups 191, 192 of four passages each. Accordingly, applicant's backshell adaptor is provided with only twelve bores that hold twelve quad terminators, to engage pins in only forty-eight of the total of one hundred fifty passages 170 of the insert 30. The fact that one hundred two passages of the insert are not used, does not detract from the fact that the insert 30 is of much lower cost than a prior art special metal insert that was used.

The quad terminator 60 can be used to connect to substantially any equipment that previously connected to a Quadrax connector which was of similar design but with a main shield front end surrounding the projecting subshields and the contact front ends, except that the present grounded main shield 90 is not as accessible for a grounding connection.

Thus, the invention provides a connection system for connecting conductors of a quad cable to a device that includes socket contacts of a size (with subshields) that can enter passages in an insert. This is accomplished by terminating the cable conductors to contacts of a quad terminator that is similar to a prior Quadrax connector, but without a main shield front end. Also, a backshell adaptor is provided with bores that each receives and retains a quad terminator, with the rear ends of the contacts and of the subshields projecting from the front face of the backshell adaptor. The backshell adaptor, preferably with at least one quad terminator installed therein, is pressed towards a rear end of a standard insert until the front ends of the terminator contacts and the subshields around them, each enters a separate one of the insert passages, and the contacts mate to rear ends of double-ended contacts, such as double-ended pins, in the insert frame passages. The backshell adaptor is mounted in place, as by mounting it on a mounting shell with at least one bay that receives the insert.

The novel features of the invention are set forth with particularity in the appended claims. The invention will be best understood from the following description when read in conjunction with the accompanying drawings.

What is claimed is:

1. A connection system for connecting the four conductors of a quad cable to terminals, the system including a quad terminator having four quad contacts connected to the quad cable conductors, an insert that has an insulative insert frame with multiple rows and columns of frame passages that extend between opposite front and rear insert ends wherein the insert also has multiple double-ended insert contacts that each lies in one of said passages, wherein front ends of a plurality of said insert contacts are each connected to one of said terminals, and the system including a mounting shell that has a bay that receives the insert, the mounting shell having a rear bay end where said insert rear end is exposed wherein:

said quad terminator has an insulator, said quad contacts have front ends projecting forward of said insulator, and said quad terminator is free of a main shield portion surrounding all four of said quad contact front ends so each contact front end can fit into the rear end of one of said frame passages and mate with one of said insert contacts; and including:

a backshell adaptor that is fastenable to said mounting shell to lie at a rear end of said bay so a front of said backshell adaptor substantially abuts the insert rear end of the insert lying in the bay, said backshell adaptor having a bore that receives and removably retains said quad terminator, with the four quad contact front ends projecting from the front end of the backshell adaptor into a different one of four of said passages of said insert frame and mating with a rear end of a different one of said four insert contacts.

2. The connection system described in claim 1 wherein:

said backshell adaptor lies rearward of said insert, said backshell adaptor is fastened to said mounting shell, said quad terminator is removably retained in said backshell adaptor and said terminator contact front ends each projects into one of said passages and engages the rear end of one of said insert contacts.

3. The connection system described in claim 1 wherein each of said double-ended insert contacts is a pin contact, and wherein:

the four contact front ends of said quad terminator are each in the form of a socket contact, and the terminator includes four subshields that each surrounds only one of said socket contacts, said subshields being spaced apart so each can fit into one of said insert passage.

4. The connection system described in claim 1 wherein:

said backshell adaptor has a plurality of bores, and including a plurality of identical quad terminator devices that include said quad terminator, with first and second of said quad terminator devices lying in adjacent ones of said bores, the contact front ends of said first and second quad terminator devices forming respective first and second groups of contact front ends;

said first and second groups of contact front ends projecting respectively into first and second groups of four each of said insert passages, said insert having at least two unused passages that do not contain said contact front ends and that lie between said first and second groups of insert passages, when said first and second quad terminator devices lie at minimum spacing while their terminators lie in said bores.

5. A connection system for connecting insulated conductors of a cable that has a grounded cable shield that surrounds the insulated conductors, to each of a plurality of terminals that, in turn, connect to front ends of insert contacts that lie in passages of an insulative insert that has an insulative insert frame with front and rear faces and rows and columns of said passages, said passages extending between said frame faces, including:

a first multi-contact terminator that is terminated to said cable, said terminator having a terminator main shield, a plurality of terminator contacts lying in said terminator main shield, and a terminator insulator lying between said terminator contacts and between said terminator contacts and said main shield, each terminator contact connected to a different one of said cable conductors, said terminator contacts each having a projecting front end that projects forward of said terminator main shield;

a backshell adaptor having a first through bore, said backshell adaptor having a front end lying faceward adjacent to said insert frame rear face;

said terminator main shield lies in said first bore and is trapped therein, and said projecting front ends of said terminator contacts project forward of said backshell adaptor bores and into rear ends of said insert passages where said contact projecting front ends engage rear ends of said insert contacts.

6. The connection system described in claim 5 wherein:

said backshell adaptor has a plurality of bores that include said first bore and at least an adjacent second bore, and said system includes a second terminator that lies adjacent to said first terminator and that has a main shield that lies in said second bore;

said first and second terminators each have four contacts with forwardly. projecting ends, the four contacts of each terminator project into a different group of four corresponding ones of said passages, but with at least two of said passages of said insert frame that lie between said two groups of passages being left empty of any terminator contact forwardly projecting end.

7. The connection system described in claim 5 including:

a mounting shell having a bay with a forwardly facing bay shoulder, said insert lies in said bay, said insert has a forwardly facing shoulder that abuts said bay shoulder, and said backshell adaptor lies rearward of said mounting shell bay and is attached to said mounting shell and holds said insert in said bay.

8. The connection system described in claim 5 wherein:

said terminator includes four of said contacts and four subshields that each surrounds of the said contact projecting front ends, each subshield projecting into one of said passages.

9. A method for connecting together a quad cable and at least four terminals comprising:

attaching a quad terminator to an end of said quad cable, wherein said quad terminator has a main shield and has four spaced-apart quad contacts with front ends projecting forwardly of said main shield, the four quad contact front ends being free of a single main shield portion surrounding all of them;

installing an insert in a bay of a mounting shell that has a rear end, wherein the insert has opposite insert ends and has rows and columns of passages extending between said insert ends and has insert contacts in the passages, each passage having passage ends of sufficient diameter to each receive one of said quad contacts;

attaching a backshell adaptor to said mounting shell so said backshell adaptor is located at said rear end of said mounting shell, wherein said backshell adaptor has at least one bore for receiving said quad terminator and said backshell adaptor has a retainer for retaining the quad terminator in a position wherein each quad contact front end projects forward beyond a front face of the backshell adaptor;

inserting said quad terminator through a rear end of said backshell adaptor into said bore of the backshell adaptor until the front ends of the four contacts of the terminator each project from the front face of the backshell adaptor and into a different passage end of the insert and mate with an end of an insert contact lying in the passage.

* * * * *